US006098609A

United States Patent [19]

Ishizuka

[11] Patent Number: 6,098,609

[45] Date of Patent: Aug. 8, 2000

[54] SUPERABRASIVE ELECTRODEPOSITED CUTTING EDGE AND METHOD OF MANUFACTURING THE SAME

[76] Inventor: Hiroshi Ishizuka, 19-2, Ebara 6-chome, Shinagawa-ku, Tokyo 142, Japan

[21] Appl. No.: 08/894,250

[22] PCT Filed: Feb. 1, 1996

[86] PCT No.: PCT/JP96/00206

§ 371 Date: Jul. 30, 1997

§ 102(e) Date: Jul. 30, 1997

[87] PCT Pub. No.: WO96/23630

PCT Pub. Date: Aug. 8, 1996

[30] Foreign Application Priority Data

Feb. 1, 1995 [JP] Japan ..... 7-051680

[51] Int. Cl.[7] ..... B28D 1/04

[52] U.S. Cl. ..... 125/13.01; 125/15

[58] Field of Search ..... 451/547; 125/13.01, 125/15, 18, 22

[56] References Cited

U.S. PATENT DOCUMENTS

| | | | |
|---|---|---|---|
| 3,640,027 | 2/1972 | Weiss | 51/206 |
| 4,407,263 | 10/1983 | Murata | 125/15 |
| 4,547,998 | 10/1985 | Kajiyama | 51/206 R |
| 4,677,963 | 7/1987 | Ajamian | 125/15 |
| 5,495,844 | 3/1996 | Kitajima et al. | 125/13.01 |
| 5,518,443 | 5/1996 | Fisher | 451/540 |
| 5,839,423 | 11/1998 | Jones et al. | 125/15 |
| 5,871,005 | 2/1999 | Sueta | 125/15 |
| 5,876,274 | 3/1999 | Hariu | 451/547 |

FOREIGN PATENT DOCUMENTS

| | | |
|---|---|---|
| 52-14289 | 3/1977 | Japan . |
| 57-3562 | 1/1982 | Japan . |
| 58-84849 | 6/1983 | Japan . |
| 58-186569 | 10/1983 | Japan . |
| 59-124574 | 7/1984 | Japan . |
| 62-144117 | 9/1987 | Japan . |
| 63-127878 | 8/1988 | Japan . |
| 63-212470 | 9/1988 | Japan . |
| 63-318269 | 12/1988 | Japan . |
| 64-42858 | 3/1989 | Japan . |
| 1-110067 | 7/1989 | Japan . |
| 1-117859 | 8/1989 | Japan . |
| 2-292177 | 12/1990 | Japan . |
| 2-311269 | 12/1990 | Japan . |
| 3-190673 | 8/1991 | Japan . |
| 4-146081 | 5/1992 | Japan . |
| 6-254768 | 9/1994 | Japan . |

*Primary Examiner*—Timothy V. Eley
*Assistant Examiner*—Dung Van Nguyen
*Attorney, Agent, or Firm*—Lyon, P.C.

[57] ABSTRACT

A cutting edge comprising a mass of superabrasive particles (2) electrodeposited on a thin-walled metallic base member (1) along a border (6) of said base member, wherein said mass (2) forms one or more layers at said border of said base member and fixed thereto, and each layer contains parts comprising at least five superabrasive particles (3) in a row in an extending direction of said base member from said border, so as to improve free-cut performance, decrease kerf width and prolong the life of cutting tool.

27 Claims, 5 Drawing Sheets

SUPERABRASIVE ELECTRODEPOSITED CUTTING EDGE AND METHOD OF MANUFACTURING THE SAME

TECHNICAL FIELD

This invention relates to a superabrasive electrodeposited cutting edge to be applied to the manufacture of various cutting or drilling tools including the types of circular and annular saw and blade, band saw, gang saw and core drill. The invention also relates to a method of manufacturing such edge, as well as tools comprising the same.

BACKGROUND ART

Tools comprising, as abrasive, particles of superabrasive such as diamond and cubic boron nitride, are produced and employed widely for cutting and drilling in various forms, such as circular and annular cutting saws and blades, band saws, gang saws and core drills. They can be categorized into powder metallurgical and electrodeposited tools by the technique applied for fixing the abrasive to the corresponding base member, or stay, of metal.

The former group, which are used principally for cutting or drilling stones, concrete blocks, and common ceramics, are produced either with a continuous peripheral edge or, more commonly, with segmented edges such that arc-shaped or rectangular chips of powder metallurgical composite of metal and diamond are brazed to a circular base plate intermittently around the periphery. Gang saws and like linear tools, with such diamond chips brazed along appropriate straight base bodies, are also used in some specific applications. However since the chips are usually brazed to the base plate mainly on the peripheral surface, which is an area only as wide as the plate thickness, there are some cases reported of abrupt chip removal due to the insufficient retention during the cutting process. So metallurgical chip tools usually rely upon a rather thick base member of steel to provide an adequate retention for the chips. Further, due to difficulty in the arrangement in alignment of the chips when brazed to the base plate, the kerf becomes even larger and thus the stock to be removed in the cutting is substantial, disadvantageously.

On the other hand, electrodeposited tools are manufactured by spreading superabrasive particles over the edge-forming section and an adjacent base plate area, and depositing metal by electrolysis to fix said particles. The process is conducted for the both sides of the base plate. Such blades can minimize the kerf loss and are often employed in applications which do not tolerate a substantial cutting loss, as in the slicing into wafers of silicon or other expensive semi-conducting material, for example. For this purpose it is desired that the overall thickness of the blade, with the edges combined, be minimized, and the number of stacked layers of abrasive particles is limited to two to three, or one. Since such small number of layers are deposited in the formation of cutting edges on the peripheral surface, which is in parallel with plate thickness, and further smaller particle sizes are favored due to the decreased kerf width and free-cut performance, the resulting tool life remains at a low level. For, in such tools, the cutting process is apparently achieved mainly with particles which are present in the cylindrical surface or on the sides of the base member in adjacency, the rest serving to a finishing work by smoothing the as-cut work surface. As the particles are worn out to expose the plate, a substantial increase in cutting load results to end the life of cutting tool.

So, while achieving a good performance in free-cut efficiency, electrodeposited tools do not necessarily exhibit a sufficient life usually with a limited number of abrasive particle layers available and effective for the cutting process. The kerf width could, and should, be less, even if they may be smaller commonly than with the above said powder metallurgic type. Some tool designs have been published which are free of such problems.

JP, U, 62-144117, for example, describes a technique of manufacturing a thin blade saw by a repeated electrodeposition of abrasive particle layers along the periphery of the base plate, while suppressing deposition on either side. While the kerf apparently can be minimized somehow by limiting the abrasive layer width close to the base member thickness, it is actually very difficult to form a stack of several layers within the given range of thickness by repeated electrodeposition processes. As a result the tool life remains rather short, with the number of stacked layers limited to two or so at maximum, in the view of the achievable form precision.

Other published techniques include the reduction of edge thickness by grinding the base member at the edge forming sites, on the both sides, before the layer of abrasive particles is deposited (as described in JP, U, 58-84849), or by depositing particles to fill a series of alternating recesses provided on the sides of a linear base member along the periphery (JP, U, 63-127878). While those techniques may be effective for decreasing somewhat the material loss by the cutting, the tools cannot show any increase in life, which ends up when the base member becomes exposed after the surface particles are substantially worn out and popped out.

Thus one of the principal objects of the invention is to provide a superabrasive deposited cutting edge and a method of manufacturing the same, which has effectively eliminated of the above described drawbacks and permits, as generally desired, a substantial improvement in tool life, while securing the inherent free-cut performance and minimal cutting width.

In the description the term "free-cut" is used to refer to a physical parameter, instead of customary usage in a somewhat subjective sense, and defined as an index of "stock removal relative to the load applied".

DISCLOSURE OF INVENTION

The inventor has achieved this invention on a finding that the above described problems could be totally removed by an edge, novel and unique, which comprises amass of superabrasive particles electrodeposited on a thin-walled metallic base member along a border thereof, said superabrasive mass comprising one or more layers of said particles, fixed to said base member and running outward therefrom, and said layer comprising each five rows, at least, of superabrasive particles as taken along said extension.

In the edge of the invention, a high free-cut performance can be achieved along with minimal cutting width and extended tool life, due to the projection length, which are effectively and uniquely increased by the invention over that conventional electrodeposition techniques could do, and which comprises five or more rows of particles in each of said layers, while the base member does not comprise any excessive particles on the body.

Such edge can be most effectively provided by a novel technique which consists another aspect of the invention, whereby a layer or layers of superabrasive particles are fixed with metal, on one side of a base member of thin-walled metallic material, by electrodeposition to spread continuously or intermittently along the margin adjacent to the border, and then said base member is ground in said margin to remove entirely or partly the material on the spot opposite to the deposition of said superabrasive particles.

In the invention, the base member of thin-walled metallic material, to form edges on, may be either one of these flat and solid forms, as well: circular or annular plates with outer or inner peripheral edges, or endless belts for band saws, straight bars for gang saws, and steel pipes for core drills.

Further the term "border" is used to mean in the invention the external periphery or circumference with some adjacent area, which defines a solid disk within in the case of a rotary circular saw or blade, and the internal one around the central hole in the case of an annular base member. For the base member of endless belt to revolve, as well as the straight bar to move back and forth, it is either one of the linear boundaries with some adjacency. In an edge structure with the stay member for the superabrasive mass, as defined in the invention, the term refers to the division between the stay and base body. The peripheral or thickness surface is any one of the faces, curved or flat and straight or inclined, to show or reveal the thickness and, thus, the plane perpendicular to the axis in the case of pipe shaped base member.

While the tool life is essentially defined and grows with the number of effective particles arranged in the edge projection or direction of cutting, the superabrasive mass to consist the cutting edge of the invention comprises a projection length, along which rows of abrasive particles are arranged and which can be readily increased as desired and substantially over what conventional techniques could achieve. At least five rows of superabrasive particles be arranged in each of the layers in said direction, in order to yield an adequate improvement in tool life.

The edge structure of the invention can be employed for wide ranging uses, with the superabrasive mass formed in various ways and deposited on various types of base bodies. The latter may be, for example, of endless belt or straight band, circular plate with- or without a central hole or serration along the border either periphery or cylindrical.

The superabrasive mass also can be arranged to form a continuous edge or an intermittent series of segmented edges, as desired when deposited in the peripheral margin.

While the concept itself of the invention can be applied to any thickness, the unique arrangement of superabrasive particles both at so high a density and precision with a secured adequate tool life, is more effective when used with a thinner base wall, and the edge is best adapted to a base thickness of or less than 1.6 mm.

The sites to be deposited with superabrasive on may be thickness reduced in advance relative to the base member, in order to minimize the elevation of the abrasive particles relative to the surface levels and, thereby, the overall tool thickness. A hollow is formed to extend in the direction perpendicular to the movement of the tool base member during the cutting process: radially in the case of circular and annular cutting tools, or in the direction of thickness in the case of band saw and gang saw type tools.

The hollow, or site of reduced thickness by scooping, is deposited with superabrasive particles which are fixed electrolytically layer by layer, to an elevation above the surface level. Here in an arrangement several masses of superabrasive particles are fixed in series to locate on the alternate sides, relative to the direction of tool movement. Hollows are formed intermittently on each side, with every adjacent ones on the alternate sides with the respective bottoms down below the central thickness level. Superabrasive particles are deposited in each hollow in stack layer by layer, to an elevation surpassing the base member surface level. In either case, particles are also preferably deposited on the opposite side.

Good precision is achieved in the edge of present invention and, thus, in the manufacture of tools. In a single side deposition or the first side deposition of two, the standard level for the first layer of deposit is completely provided in the invention by the body margin either as an entire member or as scooped partly on the back. Thus good parallelism and, thus, surface precision of the tool can be secured between the deposit and the body surface to improve the work precision, after several layers have been stacked by repeated electrolytic processes. For the second side deposition the standard level is also provided by the superabrasive deposit itself in the case the body material has been totally removed after the first deposition.

As may be obvious, the removal of base member material is conducted after the first side deposition to hold adequate retention of the deposited mass of particles to the base member. While chemical and electrochemical processes in acid or alkaline solution may be available as well electrocorrosion, mechanical work, including grinding, is especially convenient and practical for a body thickness in excess of 100 $\mu$m. A masking technique may be used at the same time for holding the base member in specific forms. The remaining thickness reduced portions of the base member, which serves as the stay member for the edges, is consumed up during the cutting process. The thickness to be kept unremoved should be something about a third or less and, preferably, about a fifth that of the body wall thickness. Also it is desirably less than the average particle size of the superabrasive employed. While the superabrasive layers are secured to the base member as deposited partly on the surface in the edge of the invention it, the retention can be increased by the use of the stay member as described above.

The margin adjacent to the border may be ground in advance over a width to reduce the thickness for forming stay members which extends outward from the base member to deposit superabrasive particles on, as well as the edge forming section. The stay member may take several forms; regularly thin walled or tapering, or both.

The edge of the invention also may take various forms, in relation to the base member. It may extend with an outward taper from the base member to exhibit a serrated general profile, and the tooth-like edge sites are effectively deposited with superabrasive particles. The joint to the base member may consist either an even- or uneven surface with some level gap, or outward declination, over which the base member changes either gradually or abruptly into stay members. The latter may be made of a material different from that of the base member, as described in detail later.

On the other hand, the base plate as totally removed of the material exposes the first deposit of superabrasive particles and metal, used to fix diamond particles, such as copper or nickel. The metal can be further used for conducting current and deposit metal to fix further superabrasive particles. The second-side deposition is conducted on the back of the first deposit so that the top of the stacked layers surpasses the base plate surface level.

In the invention the edge, with the deposits of superabrasive particles on the both sides, has an adequate overall thickness of or less than twice that of the base member, while the superabrasive mass has a projection length, off from the border, twice or more as large as the edge is thick, in order to achieve an adequate tool life.

Finer graded particles of superabrasive, than in said mass, may be deposited in an area adjacent to the cutting edges up to an elevation above each body surface level, so that polishing can be done simultaneously in the process of cutting or drilling.

It is useful for the formation of a superabrasive layers outside the border of the base plate, to spread a foil of aluminum or copper, or like thin metallic material, in adjacent, in alignment, and in electrical contact with said plate, and a layer of superabrasive particles is formed on it. This technique can also be applied to the case where the above said stay member is provided, in order to spread the superabrasive mass to and beyond the tip of said member. This metallic material can be removed, upon fixing of the abrasive particles, by treating in acid or alkaline solution. As necessary, further abrasive particles can be deposited after the removal of the auxiliary (secondary) stay member.

In the invention, the deposit of superabrasive mass is retained firmly by the base member in the abutment on the increased area of base thickness surface, base body surface adjacent to the cutting edge, and stay member, combined, for any base member designs. This construction permits the arrangement of elongated projection of a length four times, for example, as great as the thickness to comprise an accordingly increased number of superabrasive particles within in the direction of cutting.

The thin-walled blades of invention, with a decreased edge to base member thickness ratio at a plate thickness of 200 $\mu$m or less, for example, allows to efficiently concentrate the load to the cutting edge tip. Conventional tools of this type usually exhibit a ratio in excess of 2, as employing rather coarse particles, in order to achieve an adequate cutting speed, together with an acceptable tool life. A ratio less than 2 is readily available with a blade of invention which may comprise a stack of electrodeposited finer superabrasive particles.

While superabrasive particles of single size grade are basically used in an entire tool, specific cases may use particles, which have a smaller average size than the ones in the superabrasive mass, fixed to a base member surface adjacent to said mass, in order to cut a work and subsequently lap the cut surface in a single pass.

The metal to be used in the invention for fixing superabrasive particles can be selected depending on the work, among ordinary metals including nickel, cobalt, copper and their based alloy. Normal commercial products can be used as electrolyte for the process of invention. Filler of inorganic products, metallic material or lubricant may also be used to decrease the concentration.

This invention as applied to various types of tools may be used for processing a wide variety of works. So, for example, for the cutting of (1) semiconducting materials, ceramics, carbon materials, stones, ferrite, glass and jewels as applied to the band saw, (2) semiconducting materials and ceramics as annular blades, (3) semiconducting materials, ceramics, carbon materials, stones and rocks, and concrete body as circular blades, (4) stones as gang saws, and (5) core drills for making holes into various hard materials.

In the application to band saw manufacturing, the high cutting precision should be secured by using a band width so large as to allow an adequate tension.

BEST MODE FOR CARRYING OUT THE INVENTION

Now the invention is described fully in detail in reference with the attached drawings which are shown by way of examples only, and as may be obvious, not for limiting the invention.

Figure 1:
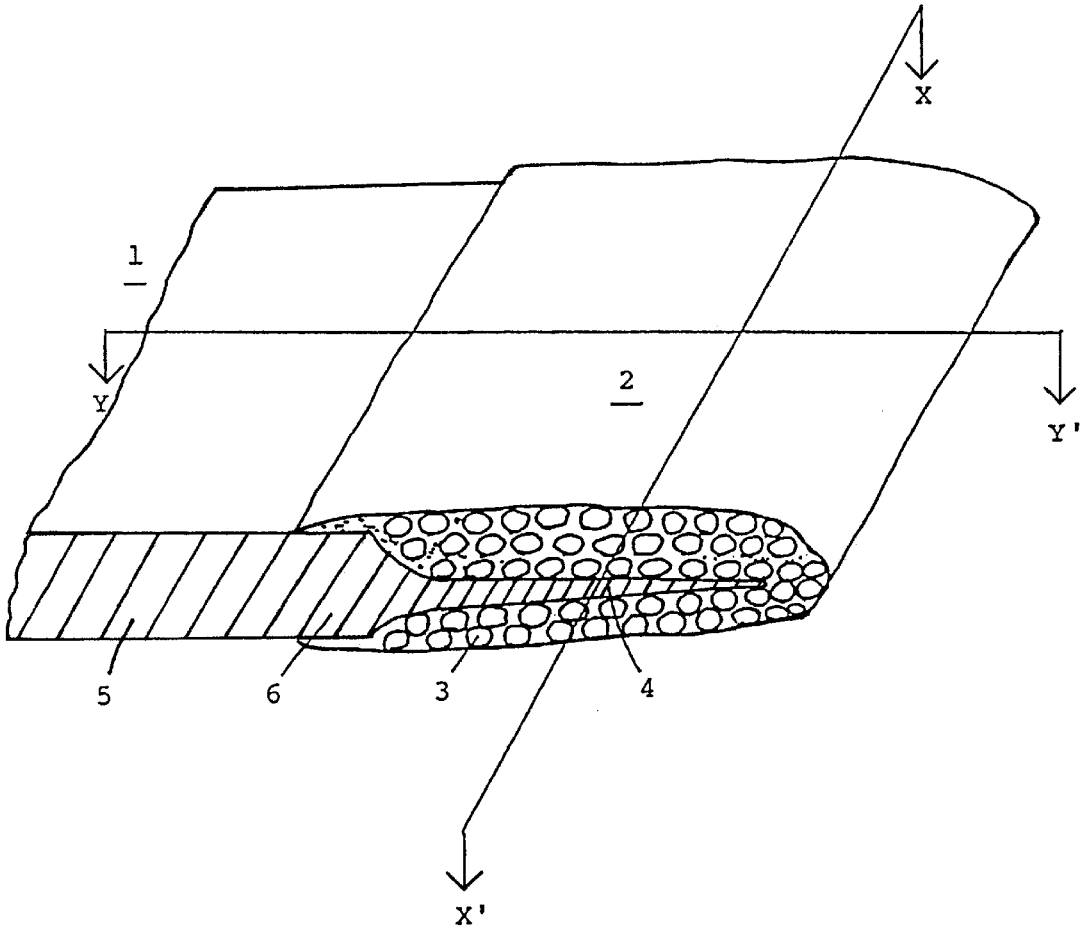
FIG. 1 shows the general view of an example of edge structure of the invention.

Referring to FIG. 1, which shows the general view of an edge structure of the invention, the base member 1 of thin-walled metallic sheet comprises in the margin 6 a mass of superabrasive particles which have been deposited in five contiguous layers, as stacked in the direction of the thickness of the base member of sheet 1, and the superabrasive mass 2 is arranged to spread off from the base body border. Each of such layers comprises 11 to 12 rows of particles 3 in the direction of the projection. The base member 1 also comprises an edge stay 4 in the margin 6 along the border, over which the (super)abrasive mass 2 is deposited, as well as the core or base body 5 in adjacency.

Figure 2A:
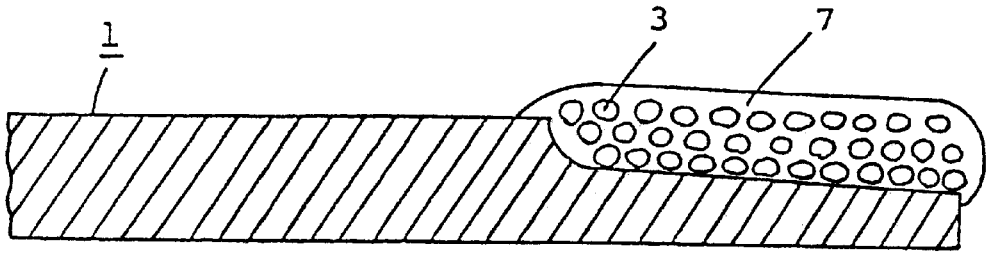
FIGS. 2A–2C shows the diagrammatic sectional illustration of the process of the invention at steps of manufacturing the edge of FIG. 1, as viewed in the section Y–Y'.
Figure 2B:
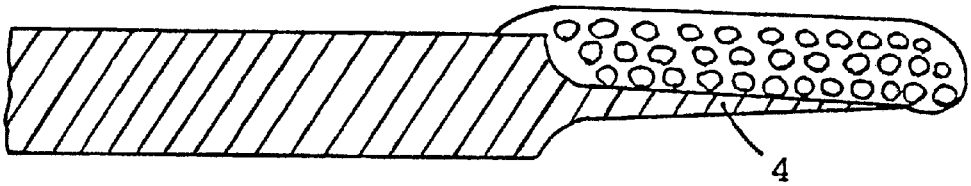
Figure 2C:
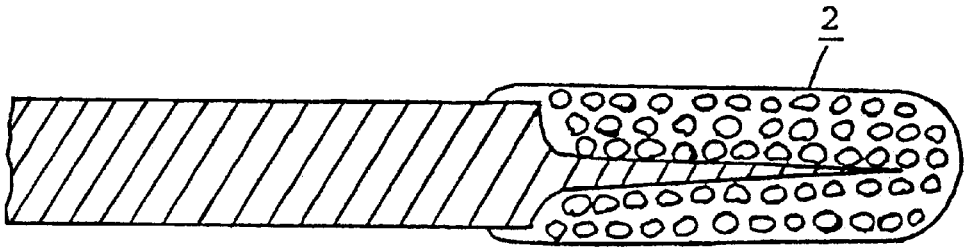
Figure 3A:
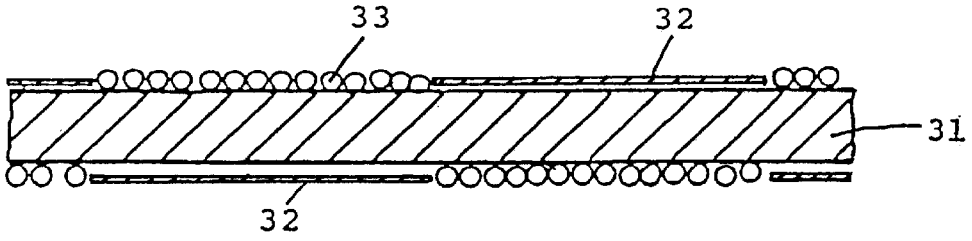
FIGS. 3A–3D shows the diagrammatic sectional illustration of the process of another edge structure, as seen in the section X–X' of FIG. 1.
Figure 3B:
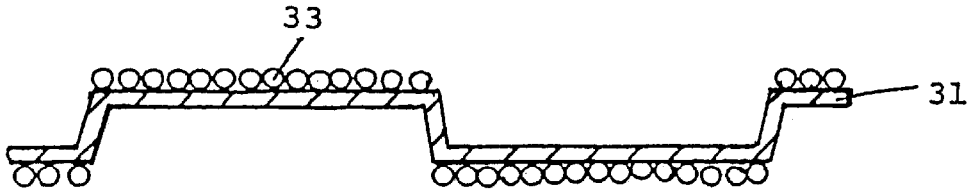
Figure 3C:
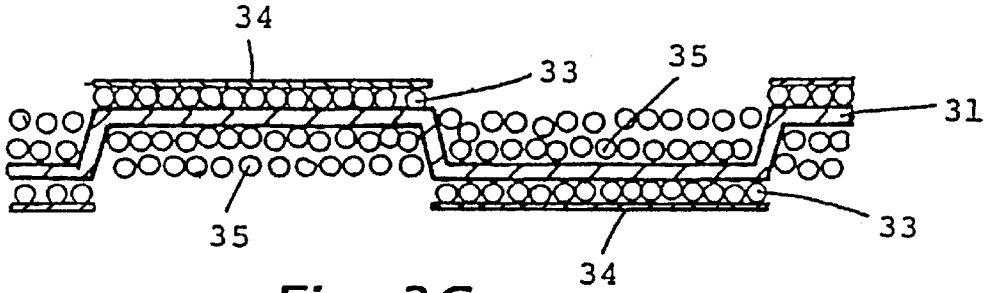
Figure 3D:
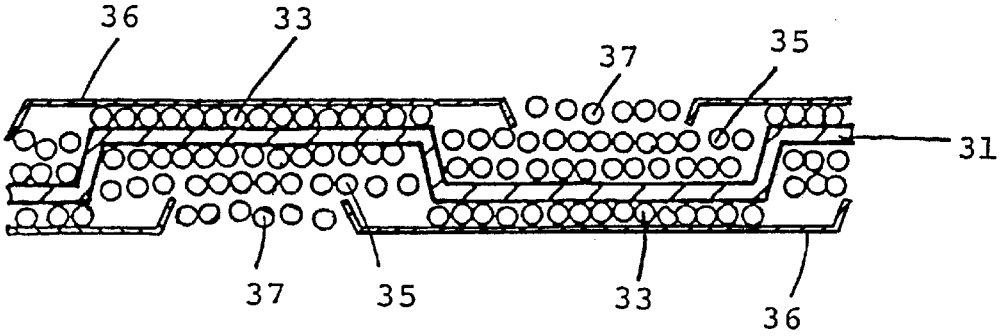
Figure 4A:
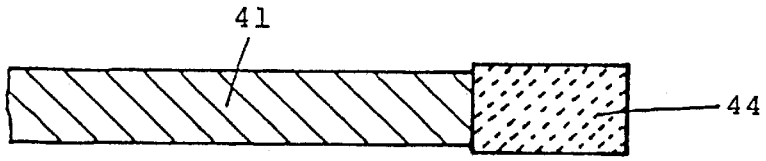
FIGS. 4A–4D shows in section examples of joint of the mass to the base member, as seen in the section Y–Y' in FIG. 1.
Figure 4B:
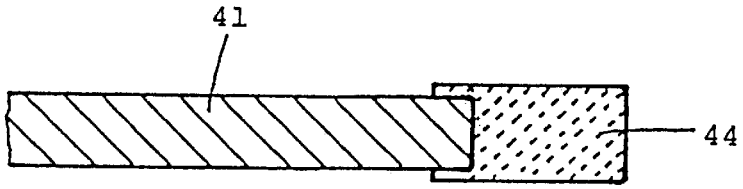
Figure 4C:
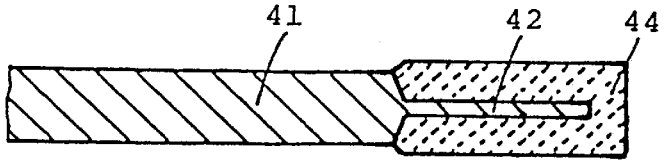
Figure 4D:
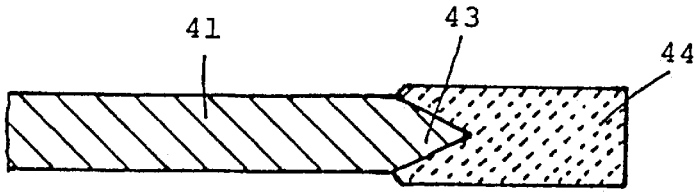
Figure 5A:
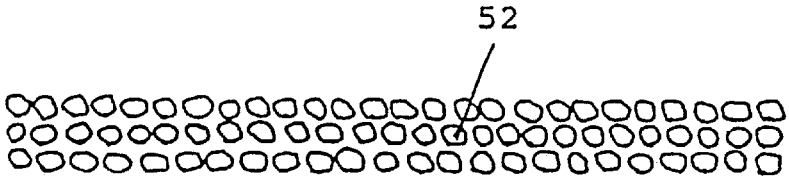
FIGS. 5A–5D shows the sectional view of a few examples of the edge structure of the invention as seen in the section X–X' in FIG. 1, which corresponds to the section Y–Y' of FIG. 1.
Figure 5B:
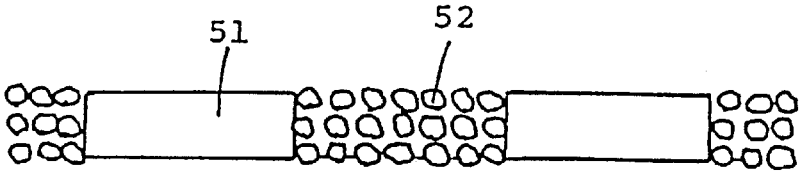
Figure 5C:
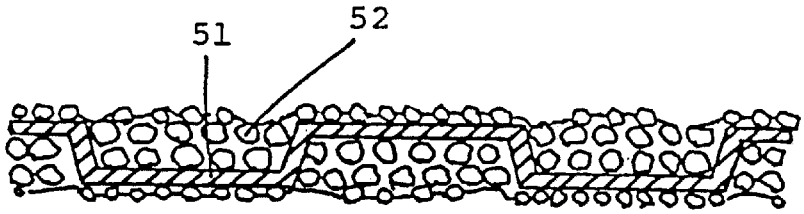
Figure 5D:
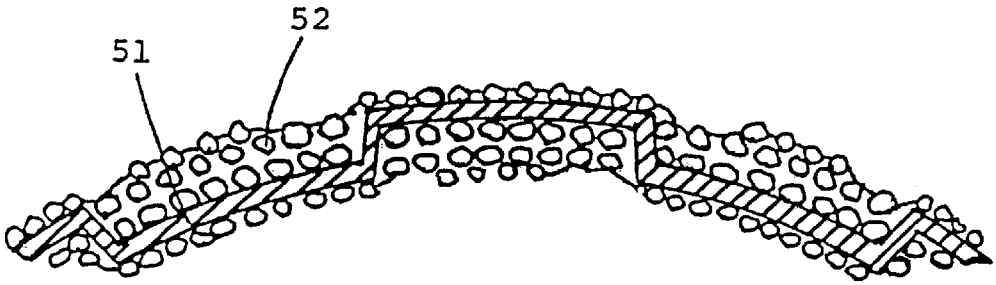

FIG. 2 schematically shows the sectional view of the base member margin of FIG. 1, taken along the line Y–Y', during the process of manufacturing the edge of the invention at some steps. In FIG. 2-A, three layers of superabrasive particles 3 are illustrated as fixed in an electrolytic process by means of deposited metal 7, after the sheet material has been removed partly in the margin on one side. FIG. 2-B shows such deposited abrasive mass with the base member partly scooped on the back. FIG. 2-C shows the edge structure process completed with two further layers of such particles 3 fixed electrolytically with deposited metal 7.

FIG. 3 shows schematically the electrodeposition process of the invention, in the section of a base member periphery, as seen in the plane X–X' of FIG. 1.

1. In the edge forming section in the base member 31, the non-deposition zones are covered with a masking piece 32, so a superabrasive layers 33 are deposited by electrolysis intermittently over a length. The above process is repeated on the reverse side (FIG. 3-A).

2. Base member material is substantially removed on the back of each deposit 33 (FIG. 3-B).

3. While the superabrasive layer 33 is covered with a masking piece 34, superabrasive layers 35 are deposited and stacked on each side in the hollows, which were formed in the previous step, in repeated electrolytic processes to an elevation close to the surface level (FIG. 3-C).

4. While a larger masking piece 36 is placed to cover partly the deposit 35 as well, another layer of superabrasive 37 is deposited on the smaller area, to surpass the layer 33 which was deposited in the previous step to complete the edge (FIG. 3-D).

FIGS. 4 and 5 show diagrammatically a few examples of arrangement of the superabrasive mass of the invention in relation to the base member.

FIG. 4 shows in section examples of joint of the mass to the base member, as taken along Y–Y' in FIG. 1. Adequate retention can be achieved for said mass 44 by abutment on the thickness surface alone of a rather thick-walled body 41 (FIG. 4-A). As seen in FIGS. 4-B to 4-D, more secure holding is necessary and can be achieved for thinner-walled bodies, by arranging the mass 44 to grip the body 41 in an area adjacent to the periphery (FIG. 4-B), or by carrying on and fixing to a stay member 42 which may be provided by working the base member margin to a regularly thin-walled sheet (FIG. 4-C) or a tapering end (FIG. 4-D).

FIG. 5 shows the sectional view of a few examples of the edge structure of the invention as taken in correspondence with X–X' in FIG. 1. The edge may be composed of superabrasive particles alone, without base or stay member to be illustrated in this section. Or the superabrasive mass may be arranged in an interrupted series as in the construction of FIG. 5-B, which shows a plurality of such mass which are arranged intermittently at a regular spacing. Another construction is illustrated in FIG. 5-C, wherein the base member is formed in zigzags, consisting of parallel lines which occur intermittently and alternately, and which are tied at ends with cross lines, as seen in this section. The hollows to occur on alternate sides are deposited with superabrasive particles. FIG. 5-D shows such arrangement of superabrasive mass 52 as applied to a cylindrical base member 51.

EXAMPLE 1

A band saw was prepared with a base member of steel, 8 m long, 120 mm wide, and 0.8 mm thick. A 3 mm wide margin along the plate periphery was used as the edge-forming section, and a layer of 60/80 mesh metal bond grade synthetic diamond particles were deposited in an ordinary electrolytic nickel plating process, over a length of 50 mm with a 50 mm spacing on the alternate sides of the plate (first-side deposition). The base member was scooped to remove material to a depth of 0.6 mm in the spots just opposite to the deposit, and then three layers of diamond particles of the same grade were deposited in a similar process (second-side deposition). The resulting blade had a total edge thickness of 1.4 mm, with the elevation above each base member surface level was 0.3 mm.

This blade was used to slice a stone. The work was a granite block with a section 0.62×0.62 m wide, and a blade speed of 1500 m/minute was used. 3 mm thick plates were cut at 0.1 $m^2$/min, with a cutting (kerf) width of 2 mm.

EXAMPLE 2

The operation of the above example was repeated to manufacture a similar band saw. The materials and process parameters were the same as in example 1, except that while in the first side deposition the elevation relative to plate surface was 0.3 mm, in the second deposition it was 0.4 mm with a third layer spread over a 30 mm length. The total abrasive layer thickness was 1.5 mm.

This blade was used to cut the stone of example 1; 3 mm thick plates were produced at the identical blade speed, and a cutting speed of 0.12 $m^2$/min.

EXAMPLE 3

In the edge-forming step in the blade manufacturing process of example 1, the 3 mm wide margin which is in adjacency with the edge-forming section was spread over and deposited with 200/230 mesh diamond particles by electroplating, with an elevation corresponding to that of the edge. The resulting blade was used to cut and polish a granite block. At a surface roughness of about 10 $\mu$m, the recovered plate could be finished to the commercial product through just a single additional work of lapping.

EXAMPLE 4

An I.D. blade was prepared using a 0.15 mm thick annular base plate, with a 180 mm hole of JIS SUS steel. To provide edge seats, the 3 mm wide margin in adjacent to the hole was intermittently ground at a spacing of 10 mm, to a depth of 0.05 mm, over a 10 mm length on the alternate sides. Masking pieces were put on the alternate sides of the base member in said bore margin at a 10 mm spacing, and 230 mesh diamond particles were deposited (first side deposition). Then the base member was processed electrolytically to remove material substantially on the spots opposite to each superabrasive deposit; two layers of 230 mesh diamond particles was placed for the second-side deposition, then a further layer was formed on the top of each deposit over the central 5 mm alone.

The blade thus obtained had edges each 3 mm high and firmly secured to the base member by the (cylindrical) inner end surface and the remnant of the plate material. The elevation of the first and second layers as combined was 0.03 mm high as from each plate surface, while the third layer was laid intermittently at a spacing of 15 mm, protruding 0.1 mm from the plate surface over a 5 mm length.

EXAMPLE 5

The annular base member of example 4 was used to prepare an I.D. blade, except that the 4 mm wide margin adjacent to the hole as edge-forming section, was deposited with 30/40 $\mu$m diamond particles by electrodeposition and then base member material was dissolved to remove in the 2 mm wide zone up from the inner end of the deposit. Then edges were formed by electroplating four layers of diamond particles of the same grade, over the back of the exposed superabrasive deposit and adjacent base member surface.

EXAMPLE 6

A disk of hardened steel, 100 mm across and 0.1 mm thick, was used as the base member for preparing a circular blade. The 2 mm-wide outer margin, adjacent to the periphery, was used for forming edges: in this zone the base member was intermittently ground on the alternate sides to a depth of 0.03 mm, over a 5 mm length at a 5 mm spacing. The scooped spots were deposited with a layer of 120/140 mesh diamond particles by electrodeposition. The base member was again scooped to remove material to a depth of about 0.07 mm on the back of each superabrasive deposit, then a layer of 120/140 mesh diamond particles were laid in each hollow.

EXAMPLE 7

The base member used was a disk of hardened steel, 100 mm across and 0.3 mm thick, with 160 of 2 mm-high triangular serration around the periphery. The teeth were ground on the alternate sides to a depth of about 0.1 mm, and deposited with 60/80 mesh diamond particles by electroplating, then the material was scooped to a depth of 0.2 mm on the back of each deposit, and finally laid with a layer of 60/80 mesh diamond particles by electrodeposition

EXAMPLE 8

A core drill was made using for the base member a pipe with an O.D. of 76.2 mm and an I.D. of 73.0 mm, and the 5.0 mm length adjacent to the end for forming edges. The body was divided with 12 slits, each 3 mm wide, into 12 segments, which were deposited intermittently on the alternate sides of the cylinder, with a layer of 60/80 mesh metal bond grade diamond particles, by normal electrodeposition of nickel, with masking pieces applied on the opposite sections accordingly (first-side deposition). Then the base member was scooped to a depth of 1.2 mm on the spots opposite to each superabrasive mass, and the hollows thus created were deposited of four layers of same grade diamond particles, by similar technique (second-side deposition) to a height of 1.9 mm, with an elevation over the base member level of 0.7 mm on the core drill.

The drill was used to make a hole into a 50 mm thick concrete block. A through hole was achieved in 2 minutes at a 2000 r.p.m. rotation. The tool exhibited a good free-cut performance after the work of 150 holes.

EXAMPLE 9

The cylindrical base member of example 8 was used to make a core drill by dividing the circular periphery into 12 segments for forming edges. The outer and inner sides of the segments were deposited alternately, for each, with two layers of 60/80 mesh metal bond diamond. The base member was scooped on the spot opposite to each deposit, and the hollows thus formed 1.2 mm deep were deposited with three layers of same grade diamond particles by a similar technique, to a combined abrasive layer thickness of 2.0 mm.

EXAMPLE 10

The cylindrical base member of example 8 was used to make a core drill by dividing the circular periphery into 12 segments for forming edges. The outer and inner sides of the segments were deposited alternately, for each, with two layers of 60/80 mesh metal bond diamond. The base member was scooped on the spot opposite to each deposit, and the hollows thus formed 1.2 mm deep were deposited with three layers of same grade diamond particles by a similar technique. The base member was further electrodeposited with two layers on the spots opposite to each deposit with 140/170 mesh diamond.

EXAMPLE 11

A core drill was made using for the base member a pipe with an O.D. of 50.8 mm and an I.D. of 48.4 mm, and the 5.0 mm length adjacent to the end for forming edges. The body was divided with 3-mm wide slits into 8 segments. Each covered with a masking piece on the outer surface, they were deposited on the outer surface of the cylinder, with a layer of 60/80 mesh metal bond grade diamond particles, by normal electrodeposition of nickel. Then the base member was scooped to a depth of 1.0 mm on the spots opposite to each superabrasive deposit and the hollows thus created were deposited of four layers of same grade diamond particles, by similar technique to a height of 1.4 mm.

EXAMPLE 12

A core drill was made using for the base member a pipe with an O.D. of 16.0 mm and an I.D. of 15.0 mm, and the 4.0 mm length adjacent to the end for forming edges. The body was not divided as in the precedent examples, but used as a continuous cylinder. It was deposited on the inner surface with a layer of 120/140 mesh metal bond diamond, by ordinary electrodeposition of nickel, while covering the outer surface with a masking piece. Then the base member was scooped on the outer surface to a depth of 0.3 mm, and same grade diamond particles were deposited there by a similar technique in four layers with a height of 0.75 mm.

REFERENCE

The cylindrical base member of example 8 was used to make a core drill by a conventional electrodeposition technique. The pipe with an O.D. of 76.2 mm and an I.D. of 73.0 mm, was divided around the circular end with 12 slits, each 3 mm wide, into 12 segments. Two layers of 60/80 mesh metal bond diamond particles were fixed in twice repeated ordinary nickel electrodeposition processes. The drill thus obtained was used to make a hole into a concrete block 50 mm thick. A through hole took 3 minutes at a 2000 r.p.m. rotation. The tool exhibited a free-cut efficiency substantially decreased after the work of 50 holes.

INDUSTRIAL APPLICABILITY

The superabrasive electrodeposited tools of the invention can be used in working of various hard materials, as applied to: a wide ranging cutting and drilling tools, such as: band saw, circular and annular saws and blades, gang saw, and core drill.

What is claimed is:

1. A cutting edge for use in cutting and drilling tools including circular saws and blades, band saws, gang saws, annular blades, and core drills, said edge comprising a mass of superabrasive particles electrodeposited on a thin-walled metallic base member along a border of said base member, wherein said mass forms one or more layers at said border of said base member and fixed thereto, each layer contains parts comprising at least five superabrasive particles in a row in an extending direction of said base member from said border, and said superabrasive mass has a projection length twice or more as great as the thickness of the base member.

2. The cutting edge as claimed in claim 1, wherein said superabrasive particles comprise one or more selected from diamond, cubic boron nitride (c-BN) and wurtzite type boron nitride (w-BN).

3. The cutting edge as claimed in claim 1, wherein said base member has a thickness of 1.6 mm or less.

4. The cutting edge as claimed in claim 1, wherein said base member comprises at the border thereof a thinner-walled stay member, to which said superabrasive mass is fixed entirely or partly.

5. The cutting edge as claimed in claim 4, wherein said stay member has a thickness of or less than a third that of said base member.

6. The cutting edge as claimed in claim 4, wherein said stay member has a thickness of or less than a fifth that of said base member.

7. The cutting edge as claimed in claim 4, wherein said stay member has a thickness less than the average size of the superabrasive particles.

8. The cutting edge as claimed in claim 4, wherein said stay member is substantially made of the same material as the base member.

9. The cutting edge as claimed in claim 4, wherein said stay member is made at least partly of different material than that of the base member.

10. The cutting edge as claimed in claim 4, wherein said base member and stay member connectedly form a continuous surface contour.

11. The cutting edge as claimed in claim 4, wherein said stay member exhibits a substantial discrepancy in surface level to the base member.

12. The cutting edge as claimed in claim 1, wherein said superabrasive mass has a thickness of or less than twice that of said base member.

13. The cutting edge as claimed in claim 1, wherein superabrasive particles which have an average size finer than that of said superabrasive mass are deposited on the base member in adjacency with said superabrasive mass.

14. The cutting edge as claimed in claim 1, wherein said superabrasive mass is arranged continuously in a direction perpendicular to said extension direction.

15. The cutting edge as claimed in claim 1, wherein said superabrasive mass is arranged intermittently in a direction perpendicular to said extension direction.

16. The cutting edge as claimed in claim 1, wherein said edge is applied to either one of circular saw/blade, annular blade, band saw, gang saw, and drilling tools.

17. A method of manufacturing a cutting edge, characterized in that a layer or layers of superabrasive particles are fixed, by an electrodeposited metal layer, continuously or intermittently, to a first surface of a margin of a base member of thin-walled metallic material, adjacent to a border and extending therefrom, and then base member material forming the margin and opposite to the deposition of said superabrasive particles is entirely or partly removed.

18. The method as claimed in claim 17, wherein a part of the base member material is removed prior to the deposition of superabrasive particles on the surface of one side adjacent to the border.

19. The method of claim 18, wherein a thin-walled metallic sheet is spread on and extends beyond said base member, and superabrasive particles are fixed thereover by electrodeposition.

20. The method of claim 17, wherein a thin-walled metallic sheet is spread on and extends beyond said base member, and superabrasive particles are fixed thereover by electrodeposition.

21. The method of claim 17, wherein said material is removed by chemical treatment in acid or alkaline medium, or by electrochemical or mechanical treatment.

22. A method of manufacturing a cutting edge, characterized in that a first layer or layers of superabrasive particles are fixed, by an electrodeposited metal layer, continuously or intermittently, to a first surface of a margin of a base member of thin-walled metallic material, adjacent to a border and extending therefrom, then base member material forming the margin and opposite to the deposition of said first layer or layers of superabrasive particles is entirely or partly removed, and then another layer or layers of superabrasive particles are fixed, by an electrodeposited metal layer, continuously or intermittently, opposite to and coextensive with the first layer or layers of superabrasive particles.

23. The method of claim 22 wherein said material is removed by chemical treatment in acid or alkaline medium, or by electrochemical or mechanical treatment.

24. A cutting edge for use in cutting and drilling tools including circular saws and blades, band saws, gang saws, annular blades, and core drills, said edge comprising a mass of superabrasive particles electrodeposited on a thin-walled metallic base member along a border of said base member, wherein said mass forms one or more layers at the border of said base member and fixed thereto, each layer comprises at least five superabrasive particles in a row with extending direction of said base member from the border, said base member comprises at the border thereof a thinner-walled stay member, to which said superabrasive mass is fixed entirely or partly, and said stay member exhibits a zigzag contour along a perpendicular direction to the extending direction from the border of said base member.

25. A method of manufacturing a cutting edge, characterized in that a layer or layers of superabrasive particles are fixed, by an electrodeposited metal layer, continuously or intermittently, to a first surface of an edge stay of a base member, the edge stay comprising a thin-walled metallic material adjacent to and extending from a border of the base member, and then the edge stay is entirely or partly removed.

26. A method of manufacturing a cutting edge, characterized in that a first layer or layers of superabrasive particles are fixed, by an electrodeposited metal layer, continuously or intermittently, to a first surface of an edge stay of a base member, the edge stay comprising a thin-walled metallic material adjacent to and extending from a border of the base member, then the edge stay is entirely or partly removed, and then a second layer or layers of superabrasive particles are fixed, by an electrodeposited metal layer, continuously or intermittently, opposite to and coextensive with the first layer or layers of superabrasive particles.

27. A cutting edge for use in cutting and drilling tools including circular saws and blades, band saws, gang saws, annular blades, and core drills, said edge comprising a thin-walled metallic base member, an edge stay, and, a mass of superabrasive particles electrodeposited along a border and over the edge stay of said base member, wherein said mass forms one or more layers at said border of said base member and fixed thereto, and each layer contains parts comprising at least five superabrasive particles in a row in an extending direction of said base member from said border, and said superabrasive mass has a projection length twice or more as great as the thickness of the base member.

* * * * *